United States Patent [19]

Maranhao

[11] 4,326,470

[45] Apr. 27, 1982

[54] INDIVIDUAL BAGASSE DRIER

[76] Inventor: Luiz E. C. Maranhao, Rua Belo Horizonte, 275, Maceió, Al, Brazil

[21] Appl. No.: 170,981

[22] Filed: Jul. 18, 1980

[30] Foreign Application Priority Data

Jul. 18, 1979 [BR] Brazil ..... 7904599

[51] Int. Cl.[3] ..... F23G 5/02

[52] U.S. Cl. ..... 110/220; 110/222; 110/224

[58] Field of Search ..... 110/220–224, 110/346, 235

[56] References Cited

U.S. PATENT DOCUMENTS

| | | | |
|---|---|---|---|
| 1,628,609 | 5/1927 | Newhouse | 110/106 |
| 2,026,366 | 12/1935 | Stehli | 110/222 |
| 2,032,402 | 3/1936 | Colby et al. | 110/224 |
| 2,148,447 | 2/1939 | Dundas et al. | 110/220 |
| 2,148,981 | 2/1939 | Dundas et al. | 110/224 |
| 2,213,668 | 9/1940 | Dundas et al. | 110/222 |
| 2,259,967 | 10/1941 | Vogel-Jorgensen | 110/222 |

*Primary Examiner*—Henry C. Yuen
*Attorney, Agent, or Firm*—Irvin A. Lavine

[57] ABSTRACT

The invention objective a Individual Bagasse Drier that realizes a system of utilization of the chimney gases, to decrease the moisture of the bagasse left from the mill in 10 or 15 points, increasing the steam production between 13.5% to 15.45% respectively.

It consists of a drier for each furnace, and consumes 54% of the power installed per ton of dry bagasse, in relation to the existing systems in the market.

6 Claims, 1 Drawing Figure

INDIVIDUAL BAGASSE DRIER

Figure 1:
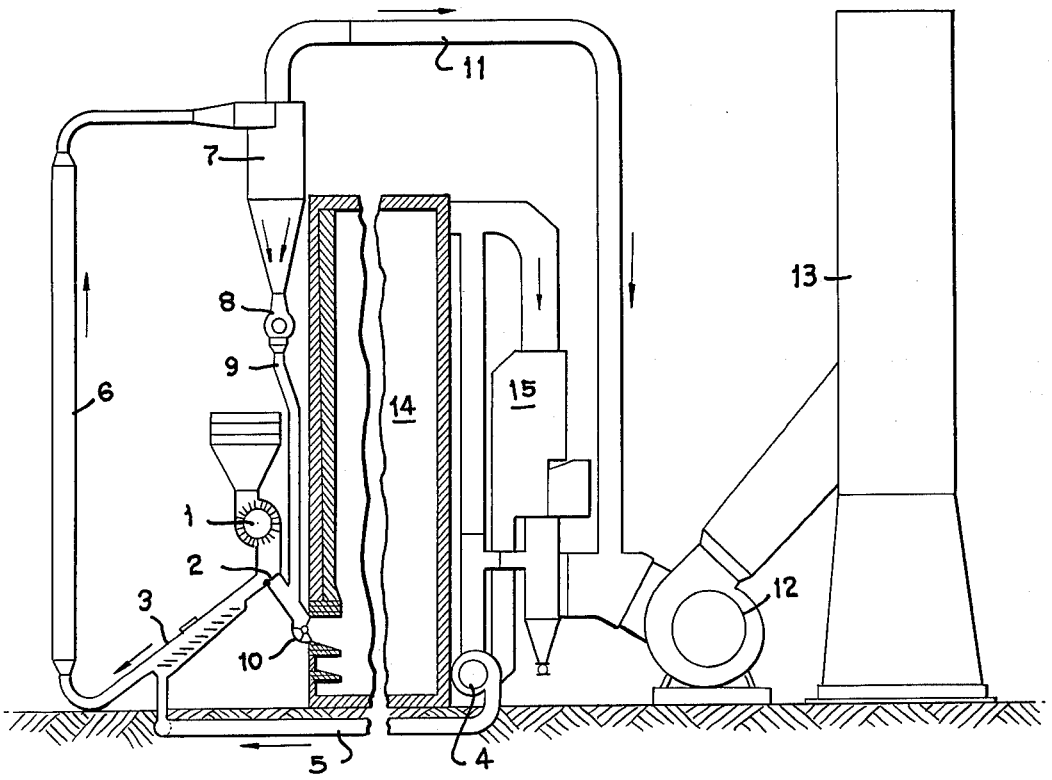

With the present day energy crisis in the world, it became important to undertake research to find new sources of energy or to increase the results obtained from the existing fuels.

The sugar cane industry, can be independent in fuels, when making raw or white sugar, or ethyl alcohol from cane.

But, the complex factories, that make the raw sugar and at the same time make alcohol from molasses and white refinery sugar, need to use auxiliary fuel oil or wood to supply the high steam demand.

In Brazil the problem is most serious, because Brazil imports 80% of its total consumption of petroleum, and now has quotas for fuel oil and diesel oil.

The new sugar factories which only make raw sugar or white standard sugar, have a medium steam consumption of 500 Kg per metric ton of crushed cane.

It is estimated that an annexed refinery in a sugar factory consumes 120 Kg per ton of crushed cane and an alcohol annexed distillery consumes 65 Kg of steam per ton of crushed cane. Therefore, a whole factory has a total consumption of 185 Kg of steam per ton of crushed cane.

The foregoing numbers are ideal values of consumption of steam, because the majority of the factories in Brazil consume 580 Kg of steam per ton of cane, only when making white standard sugar.

Yet to get a good extraction by the mills, it is necessary to increase the imbibition level to over 250% fibre, that normally increase the bagasse moisture to 52% or more, making it difficult to burn it in the furnaces.

In Brazil we consider an average production of steam per Kg of burned bagasse, the folowing values:

Modern boilers with, pre-heated air, spreader stokers, bagasse feeders and grates, which get 2.20 Kg of steam per Kg of burned bagasse, with 50% of moisture.

Old boilers, with pre-heated air, but without the other equipments, obtain only 1.85 Kg of steam per Kg of bagasse.

We take as an average production 2.0 Kg of steam per Kg of bagasse with 50% of moisture, for the majority of sugar factories, with 13% of fibre in cane and 28% of bagasse in cane, so we will have a production of steam of about 560 Kg per ton of crushed cane, that sometimes is not sufficient to supply the crushing of a simple sugar factory without annexed refinery or distillery.

The intention of this invention is to achieve self sufficiency in fuel in the most complex sugar factories, or to have some bagasse left in the simple factories, through a process of drying the bagasse after leaving the mills, decreasing the moistures from 50% or 52% to 40%.

To obtain these results we have studied the different ways of drying the bagasse, and have found that all the manufacturers use the same way, as shown below:

(1) To dry all available bagasse, at the same time.

(2) To return the dried bagasse on conveyors to feed the different boilers.

This conventional procedure presented several problems that increased the cost of installation and operation, as follows:

(a) High cost of initial investment.

(b) Difficulty in enlarging the installation.

(c) The necessity of a large space for the equipment.

(d) High power consumption per Kg of dried bagasse.

(e) The necessity to set new auxiliary conveyors for the bagasse.

The invention envisions an economic way and of great advantages for the drying of the bagasse, utilizing the calorific resources from the flue gases of the boiler individually.

The invention takes the bagasse feeders existing in the boiler, as the starting point of an individual drier which is annexed to each furnace, with the utilization of the calorific energy of the flue gases, for drying the bagasse to be consumed, without necessity of drier and conveyors installations.

The invention provides a system of gas utilization from the chimney of the boiler to decrease the bagasse moisture left from the mill by 10 to 15 percent increasing the steam production between 13.5% and 15.45% respctively.

The invention provides a drier for each furnace, with a power consumption per ton of dried bagasse of only 54% compared to the others processes of drying.

The individual drier utilizes the exauster to produce a reduced air pressure that takes the moist bagasse produced by the feeder of the boiler to a special box, where it is mixed with the hot gases of the same boiler. Through the draft effects from the exauster, and the pressure of an extra fan to effect suction of flue gases, there is decreased the moisture of bagasse before putting it in the furnace.

The invention will be better understood through the single FIGURE, which shows its installation in a furnace.

Under the bagasse feeder (1), shutting its entrance to the furnace is a baffle plate (2) which causes the bagasse to go through a chamfer (3) where it is mixed with hot gases that flow through a tube (5), from a fan (4) sucking such hot gases from the furnace exhaust in advance of the pre-heater (15) of the boiler, discharging them into the chamfer (3).

The mixed bagasse with hot gases is pushed to the base of the cylindrical column (6) that takes it to a separator (7), where bagasse passes to a rotative feeder (8), going out through a vertical tube (9), taking it to the spreader-stokes (10), that trow the dry bagasse in the furnace for combustion.

A tube (11) joins the gas outlet of the cyclone separator (7) to the gas impeller or exauster 12 of the boiler, so that while it pushes the gases to the chimney (13), it helps in drawing the bagasse to cyclone separator (7), by the draft caused in tube (6).

The installation can be done in any existing boiler, becoming unnecessary the utilization of an axiliary conveyor.

The bagasse drying decreases its moisture from 50% to 40%, increases the steam production per Kg of burnt bagasse by about 15.35%. With the decreasing of moistures, from 50% to 35%, the increase in steam production is about 20%.

In the calculation of the increase of steam production, the power consumed to dry the bagasse has been taken into account.

In this invention, we use the draft from the exauster to dry the bagasse. Experiences with an average of 45000 kg/h bagasse gave the following results:

(a) In table I we present the results of drying, using bagasse with several different moistures, and using flue gases of 220° C.

TABLE I

| Results of dried bagasse with several different moistures. | | | |
|---|---|---|---|
| Initial moisture | Final moisture | Weight of initial dried bagasse | Weight of water removed bagasse |
| 55% | 46% | 83.3% | 166.6 Kg |
| 50% | 40% | 83.3% | 166.6 Kg |
| 46% | 35% | 83.07% | 169.2 Kg |

(b) Some tests were made, with the flue gases obtained after the air-heater of 220° C., and other tests, where we got the gases were obtained before the air-heater, at 300° C., the efficiency of drying bagasse by using the hotter gases was increased to about 68%.

(c) In the tests with the highest temperature (300° C.), the bagasse left the dryer at 40° C., and the wet gases with 105° C. Thus, we see that flue gases from a bagasse drier have a temperature 50% lower than the flue gases of a conventional air-heater.

(d) The control of this system it is very simple, because it only needs suction on the top exit of the cyclone (7). This control is made by using a hand disc valve on a tube which transfer the wet gases to the chimney fan.

(e) The total costs of this system is equal to 60% of the price of the majority of the existing dryers, and the power consumption is about 56% of other dryers. However, there is obtained the same efficiency as the others.

(f) This system can be installed on any existing boiler, and it is possible to dry a portion of the bagasse, or all the bagasse of the boiler, and no auxiliary bagasse conveyor is necessary.

(g) This system consumes about 50% of the flue gases from the boiler in which it is installed. If we use the hot gases taken from the pre-heated air which are at 220° C., the moisture will be decreased 10 points. But, if we take the gases before the preheated air which is at 300° C., the moisture is decreased 15 points.

Theoretically, there are the following advantages in drying the bagasse:

(a) In table II, there is shown the increase of Gross calorific value and the net calorific value when we dry the bagasse, from 50% of the moisture to 40% and 35%.

From Hugot, we have:

G.C.V=4,600−12.5. S−46. W

N.C.V=4,250−12.5. S−48.5. W

With this formulae we obtain the following table:

TABLE II

| Variation of G.C.V. and N.C.V. with the moisture of gabasse | | | | | | |
|---|---|---|---|---|---|---|
| | G.C.V. Kcal/kg | N.C.V. Kcal/kg | Increase N.C.V. | Corrected N.C.V. | Weight Of dry Bagasse | Increase Corrected N.C.V. |
| W = 50% | 2,270 | 1,800 | 0 | 1,800 | 100% | 0 |
| W = 40% | 2,730 | 2,300 | +27,8% | 1,915 | 83,3% | +6,4% |
| W = 35% | 2,960 | 2,525 | +40,3% | 1,944 | 77% | +8% |

(b) Decrease in the excess air necessary for combustion, from 60% and 50% to 20%.

(c) Increase in the furnace temperature to about 20.5% and 30%, as we can see in table III.

TABLE III

| Combustion temperature in bagasse furnacees | | | |
|---|---|---|---|
| | m = 1.5 | m = 1.3 | m = 1.2 |
| W = 50% | 1,040° C. | 1,120° C. | — |
| W = 40% | 1,165° C. | 1,254° C. | 1,300° C. |
| W = 35% | 1,210° C. | 1,280° C. | 1,350° C. |

(d) Increase in the velocity of combustion and absorption of heat in the water walls of the boiler.

(e) As seen, there was a good increase in the temperature of the furnaces. However there was an important decrease of heat losses in flue gases, because the dry bagasse only needs 20% or 25% of excess air, and 50% of the weight of the flue gases are used to dry the bagasse and they leave the dryer at about 100° C. There is shown in table IV:

TABLE IV

| | m = 1.5 | | m = 1.3 | | m = 1.2 | |
|---|---|---|---|---|---|---|
| Kcal/kg | tr = 220° C. t2 = 160° C. | tr = 300° C. t2 = 200° C. | tr = 220° C. t2 = 160° C. | tr = 300° C. t2 = 200° C. | tr = 220° C. t2 = 160° C. | tr = 300° C. t2 = 200° C. |
| W = 50% | 326.7 | 445.5 | 295.9 | 403.5 | | |
| W = 40% | 285.9 | 420.5 | 257.4 | 248.5 | 243.1 | 357.5 |
| W = 35% | 267.03 | 409.5 | 239.9 | 368 | 226.2 | 346.7 |

(f) Decreases the heat loss by imperfect burning of the bagasse, because with the dry bagasse the combustion is almost complete, and due to the recuperation of solid unburnt by the cyclones of the dryer.

(g) Pollution was decreased due to the lower volume of flue gases and lower quantity of solids unburnt dry bagasse, as seen in table IV. It was calculated by using the formula $V_gN=4.45(1-W).\ m.+0.572\omega+0.672.$ and making the necessary weight correction, when the bagasse was dried.

TABLE V

| Volume of gases m³/Kg of bagasse | | | | |
|---|---|---|---|---|
| m³/Kg | Weight of Bagasse | m = 1,5 t = 220° C. | m = 1,3 t = 220° C. | m = 1,2 t = 220° C. |
| W = 50% | 1 | 7.75 | 6.95 | — |
| W = 40% | 1 | 8.87 | 7.89 | 7.41 |
| | 0.833 | 7.39 | 6.57 | 6.17 |
| W = 35% | 1 | 9.41 | 8.36 | 7.84 |
| | 0.77 | 7.24 | 6.44 | 6.04 |

(h) Increases in the quantity of steam which can be obtained from unit weight of burnt bagasse, as seen in table V, calculated by using the formula of Hugot, $M_\nu=(PCI_\omega-q_\omega).\alpha.\beta.\eta.$

TABLE VI

| Increase of heat transmitted to stean per Kg. of bagasse | | | | |
|---|---|---|---|---|
| Kcal/Kg. | Weight of bagasse | m = 1.5 t = 220° C. | m = 1.3 t = 220° C. | m = 1.2 t = 220° C. |
| W = 50% | 1 | 1,274 | 1,301 | — |
| W = 40% | 1 | 1,819 | 1,845 | 1,858 |
| | 0.833 | 1,471 | 1,497 | 1,510 |

TABLE VI-continued

| Kcal/Kg. | Weight of bagasse | m = 1.5 t = 220° C. | m = 1.3 t = 220° C. | m = 1.2 t = 220° C. |
|---|---|---|---|---|
| | Increase of heat transmitted to stean per Kg. of bagasse | | | |
| W = 35% | 1 | 2,061 | 2,085 | 2,098 |
| | 0.77 | 1,530 | 1,555 | 1,568 |

(i) Increase of the quantity of steam per unit weight of bagasse. The table VI shows the various coefficients when we consider the feed boiler which is at 90° C., and discounting the decreases in the weight of bagasse that is being dried.

TABLE VI

| Steam | W = 50% m = 1.5 t = 220° C. | W = 50% m = 1.3 t = 220° C. | W = 40% m = 1.3 t = 220° C. | W = 40% m = 1.2 t = 220° C. | W = 35% m = 1.2 t = 220° C. |
|---|---|---|---|---|---|
| | Weight of steam produced per unit weight of bagasse, for different moisture and excess air. | | | | |
| 16 Kg/cm$^2$ | 2.21 | 2.25 | 2.59 | 2.62 | 2.72 |
| 20 Kg/cm$^2$ | 2.20 | 2.25 | 2.59 | 2.61 | 2.71 |
| 20 Kg/cm$^2$ 300° C. | 2.02 | 2.06 | 2.37 | 2.39 | 2.48 |
| 30 Kg/cm$^2$ 300° C. | 1.95 | 1.99 | 2.29 | 2.31 | 2.40 |
| 30 Kg/cm$^2$ 400° C. | 1.87 | 1.91 | 2.20 | 2.22 | 2.30 |

According to William P. Boulet and J. H. Furines, to dry the bagasse is the best solution to eliminate a dependency, in the sugar industry, on auxiliary combustibles, and to diminish the problem of air pollution.

It is important that the system of drying be easy to operate and flexible to avoid stops not expected in an industrial operation.

I claim:

1. In combination with a furnace for burning bagasse, wherein the furnace includes a fuel entrance and an exhaust for gasses, a bagasse heating chamber, means for feeding bagasse to said chamber, means for supplying heated gas to said chamber, a gas-solid separator including an inlet for solid material and gas, an outlet for gas, and an outlet for solid material, means for conveying heated bagasse and moisture-laden gas from said chamber to the inlet of said gas-solid separator, means for connecting the solid material outlet of the separator to the fuel entrance of said furnace, gas impelling means having an inlet, means for connecting the inlet of the impelling means to the furnace exhaust for gases, means for connecting the inlet of the gas impelling means to the outlet for gas of said separator, and said bagasse feeding means comprising a feeder located above the fuel entrance of said furnace, a conduit extending from the feeder and having branches to the fuel entrance and to the chamber, and a baffle plate blocking the branch to the fuel entrance.

2. The combination of claim 1, and means for creating a reduced pressure at the outlet of the conveying means for bagasse and air.

3. The combination of claim 1, said means for supplying heated gas to said chamber comprising a conduit connected to the exhaust of said furnace.

4. The combination of claim 3, said means for supplying heated gas comprising a blower.

5. The combination of claims 3 or 4, said conduit connected to said furnace exhaust ahead of said preheater.

6. In combination with a furnace for burning bagasse, wherein the furnace includes a bagasse hopper and feeder connected by a conduit with stoker means at the inlet of said furnace, and wherein flue gas is drawn through a conduit to the inlet of a gas impeller, the outlet of which is connected to a chimney, a bagasse heating chamber having an inlet for bagasse adjacent said furnace inlet, an outlet, a branch conduit connected to said heating chamber inlet and to the conduit connecting the bagasse feeder with the stoker means, a baffle plate blocking the conduit to said stoker means for supplying heated gas to said chamber comprising:

(a) heating gas conduit means for receiving flue gasses from said furnace and for delivering said flue gasses to said chamber, and (b) fan means for driving flue gasses through said heating gas conduit means, a gas solid separator having an inlet for solid material and gas, an outlet for gas, and an outlet for solid material, conduit means extending downwardly from the solid material outlet to the furnace inlet, conduit means extending from the heating chamber outlet to the inlet of the separator, and a conduit extending from the gas outlet of the separator to the inlet of the gas impeller.

* * * * *